US008448627B2

(12) United States Patent
Kondo et al.

(10) Patent No.: US 8,448,627 B2
(45) Date of Patent: May 28, 2013

(54) THROTTLE VALVE CONTROL DEVICE

(75) Inventors: Masanobu Kondo, Nagoya (JP); Toru Sakurai, Obu (JP); Atsushi Tanaka, Anjo (JP)

(73) Assignee: Aisan Kogyo Kabushiki Kaisha, Aichi-ken (JP)

( * ) Notice: Subject to any disclaimer, the term of this patent is extended or adjusted under 35 U.S.C. 154(b) by 355 days.

(21) Appl. No.: 12/875,334

(22) Filed: Sep. 3, 2010

(65) Prior Publication Data

US 2011/0056461 A1 Mar. 10, 2011

(30) Foreign Application Priority Data

Sep. 9, 2009 (JP) ..... 2009-207942

(51) Int. Cl.
*F02D 9/08* (2006.01)
*F02D 11/10* (2006.01)

(52) U.S. Cl.
USPC ..... 123/399; 123/361

(58) Field of Classification Search
USPC .. 123/337, 361, 396, 399, 403, 400; 251/173, 251/174, 305; 267/123
See application file for complete search history.

(56) References Cited

U.S. PATENT DOCUMENTS 6,918,374 B1 * 7/2005 Kurita et al. ..... 123/396
6,925,986 B2 8/2005 Cannone et al.
6,986,336 B2 * 1/2006 Tanimura et al. ..... 123/343
7,051,707 B2 5/2006 Tanimura et al.
7,275,557 B2 * 10/2007 Piciotti et al. ..... 137/15.25
7,302,931 B2 * 12/2007 Saito et al. ..... 123/396
7,503,309 B2 * 3/2009 Tanimura et al. ..... 123/396
2008/0011269 A1 * 1/2008 Tanimura et al. ..... 123/337

FOREIGN PATENT DOCUMENTS

| | | |
|---|---|---|
| DE | 10 2004 040 632 | 1/2006 |
| DE | 60 2004 006 038 | 1/2008 |
| EP | 1 441 117 | 7/2004 |
| JP | 06-117281 | 4/1994 |
| JP | 2004301118 | 10/2004 |
| JP | 2006-291912 | 10/2006 |

* cited by examiner

*Primary Examiner* — Stephen K Cronin
*Assistant Examiner* — John Zaleskas
(74) *Attorney, Agent, or Firm* — Ladas & Parry LLP

(57) ABSTRACT

An electronically-controlled throttle valve control device may include a coil spring that is engaged with a throttle body and a rotating body to bias a throttle valve in a fully opening direction and a fully closing direction, a spring guide that is provided to the rotating body and is capable of supporting the coil spring from inside, and an opener member that is provided to the rotating body and is biased by the coil spring in the fully opening direction or the fully closing direction. The coil spring includes a first coiled portion that is capable of biasing the throttle valve in a first direction, a second coiled portion that is capable of biasing the throttle valve in a second direction, and an intermediate coiled portion that is positioned between the first and second coiled portions. The coil spring is formed such that a central axis of the intermediate coiled portion is displaced radially outwardly relative to a central axis of the first coiled portion.

3 Claims, 6 Drawing Sheets

THROTTLE VALVE CONTROL DEVICE

This application claims priority to Japanese patent application serial number 2009-207942, the contents of which are incorporated herein by reference.

BACKGROUND OF THE INVENTION

1. Field of the Invention

The present invention relates to a throttle valve control device of an internal combustion engine. More particularly, the present invention relates to an electronically-controlled throttle valve control device of an internal combustion engine.

2. Description of Related Art

An electronically-controlled throttle valve control device of an internal combustion engine is taught, for example, by Japanese Laid-Open Patent Publication No. 2004-301118.

As shown in FIGS. 9 and 10, this electronically-controlled throttle valve control device includes a throttle body 114, a throttle valve 104, a gear reducer 126 and a coil spring 100. The throttle body 114 has an air intake passage 114*a* that is formed therein. The throttle valve 104 is connected to a throttle shaft 105 and is received in the air intake passage 114*a* of the throttle body 114 so as to close and open the air intake passage 114*a*. The throttle shaft 105 is rotatably attached to the throttle body 114.

The gear reducer 126 is arranged and constructed to transfer a rotative force of a drive motor 110 (an actuator) to the throttle valve 104. In particular, the gear reducer 126 is constructed of a valve gear 111, a pinion gear 113 and an intermediate reduction gear 112. The valve gear 111 is connected to the throttle shaft 105, so as to rotate the throttle valve 104 in a fully opening direction and a fully closing direction. The pinion gear 113 is connected to an output shaft of the drive motor 110. The intermediate reduction gear 112 is meshed with the valve gear 111 and the pinion gear 113. The coil spring 100 is constructed of a single torsion coil spring. One end portion 100*a* of the coil spring 100 engages an engagement portion 121 that is positioned in a side of the throttle body 114. Conversely, the other end portion 107 of the coil spring 100 engages an engagement portion 122 formed in an opener member 106 attached to the valve gear 111.

Further, the valve gear 111 has a spring guide 108 that is capable of supporting a valve gear-side coiled portion of the coil spring 100 from inside. Conversely, the throttle body 114 has a spring guide 125 that is capable of supporting a throttle body-side coiled portion of the coil spring 100 from inside. Further, the opener member 106 of the valve gear 111 is biased by the coil spring 100 in the fully opening direction or the fully closing direction of the throttle valve 104.

The coil spring 100 has a first spring portion 101 having a coiled portion, a second spring portion 102 having a coiled portion, and a U-shaped hook portion 103. The first spring portion 101 biases the opener member 106 of the valve gear 111 in a direction in which the throttle valve 104 can be closed from a position opened beyond a middle position toward the middle position. To the contrary, the second spring portion 102 biases the opener member 106 of the valve gear 111 in a direction in which the throttle valve 104 can be opened from a position closed beyond the middle position toward the middle position. Further, the first spring portion 101 has a spring force greater than the spring force of the second spring portion 102. The U-shaped hook portion 103 is formed by bending a portion of the coil spring 100 (a boundary portion of the first and second spring portions 101 and 102) to a substantially U-shape. As a result, the coil spring 100 has a coiled portion (an intermediate coiled portion) 103*a* that is positioned adjacent to or continuous with the U-shaped hook portion 103 and is positioned between the coiled portions of the first spring portion 101 and the second spring portion 102.

Further, the U-shaped hook portion 103 may function as a winding direction changeover portion in which winding directions of the first spring portion 101 and the second spring portion 102 are changed over. That is, the first spring portion 101 has a winding direction different from the second spring portion 102. Further, the U-shaped hook portion 103 engages an engagement portion 124 formed in the opener member 106 by a spring force of the second spring portion 102. Further, the U-shaped hook portion 103 is capable of engaging an intermediate stopper member 115 disposed in a throttle body-side when the throttle valve 104 is closed from the middle position toward the fully closed position thereof.

Therefore, if electric power supplied to the drive motor 110 is stopped or lost, the throttle valve 104 can be maintained in the middle portion due to a difference between the spring force of the first spring portion 101 and the spring force of the second spring portion 102, so that the internal combustion engine can be prevented from being suddenly stopped. Thus, a vehicle can be moved to a safe place.

However, in the electronically-controlled throttle valve control device thus constructed, the intermediate coiled portion 103*a* of the coil spring 100 that is positioned adjacent to the U-shaped hook portion 103 is formed to be coaxial with a central axis of each of the coiled portions of the first and second spring portions 101 and 102 (i.e., a central axis of remaining coiled portions of the coil spring 100). Therefore, in a condition in which the coil spring 100 is attached to the valve gear 111, due to a reactive force of the second spring portion 102, the intermediate coiled portion 103*a* of the coil spring 100 can be strongly pressed against the spring guide 108 of the valve gear 111 in a direction shown by an arrow Y in FIG. 10.

When the throttle valve 104 is closed and opened between the middle position and the fully closed position, the valve gear 111 is rotated while the U-shaped hook portion 103 of the coil spring 100 engages or contacts the intermediate stopper member 115 of the throttle body 114. As a result, the spring guide 108 of the valve gear 111 can move or rotate relative to the intermediate coiled portion 103*a* of the coil spring 100. At this time, because the intermediate coiled portion 103*a* of the coil spring 100 is pressed against the spring guide 108 of the valve gear 111 due to the reactive force of the second spring portion 102, a large sliding frictional force can be generated between the intermediate coiled portion 103*a* and the spring guide 108. As a result, a large rotational load can be applied to the drive motor 110. Also, a noise can be generated between the intermediate coiled portion 103*a* and the spring guide 108.

BRIEF SUMMARY OF THE INVENTION

For example, in one embodiment of the present invention, an electronically-controlled throttle valve control device may include a throttle body having an air intake passage formed therein, a throttle valve that is received in the air intake passage so as to close and open the air intake passage, a power transmission device having a rotating body that is capable of transferring a rotative force of an actuator to the throttle valve and rotating the throttle valve in a fully opening direction and a fully closing direction, and a coil spring having one end portion that is engaged with the throttle body and the other end portion that is engaged with the rotating body. The coil spring is arranged and constructed to bias the throttle valve in the fully opening direction or the fully closing direction. The rotating body has a spring guide that is capable of supporting the coil spring from inside and has an opener member that is biased by the coil spring in the fully opening direction or the fully closing direction. The coil spring includes a first spring portion that is capable of biasing the throttle valve via the opener member in a direction in which the throttle valve can be closed from a position opened beyond the middle position toward the middle position, a second spring portion that is capable of biasing the throttle valve via the opener member in a direction in which the throttle valve can be opened from a position closed beyond the middle position toward the middle position, and a winding direction changeover portion in which winding directions of the first and second spring portions are changed over. The coil spring is arranged and constructed such that a pressing force of a coiled portion positioned adjacent to the winding direction changeover portion against the spring guide of the rotating body can be reduced.

According to the electronically-controlled throttle valve control device thus constructed, the pressing force of the coiled portion positioned adjacent to the winding direction changeover portion against the spring guide of the rotating body can be reduced. Therefore, in a condition in which the coil spring is attached to the rotating body, when the coiled portion positioned adjacent to the winding direction changeover portion is pressed against the spring guide of the rotating body due to a reactive force of the second spring portion, the coiled portion positioned adjacent to the winding direction changeover portion can be prevented from being strongly pressed against the spring guide. Thus, when the spring guide of the rotating body moves or rotates relative to the coiled portion positioned adjacent to the winding direction changeover portion of the coil spring, a sliding frictional force generated between the spring guide and the coiled portion positioned adjacent to the winding direction changeover portion can be reduced. As a result, a rotational load applied to the actuator can be reduced. Further, a noise generated between the coiled portion positioned adjacent to the winding direction changeover portion and the spring guide can be prevented.

Further, the coil spring can be formed such that the coiled portion positioned adjacent to the winding direction changeover portion is positioned radially outwardly relative to a remaining coiled portion. In particular, the coil spring can be formed such that a central axis of the coiled portion positioned adjacent to the winding direction changeover portion is displaced radially outwardly relative to a central axis of a remaining coiled portion.

Other objects, features, and advantages, of the present invention will be readily understood after reading the following detailed description together with the accompanying drawings and the claims.

DETAILED DESCRIPTION OF THE INVENTION

Next, a representative embodiment of the present invention will be described with reference to FIGS. 1 to 8.

Figure 1:
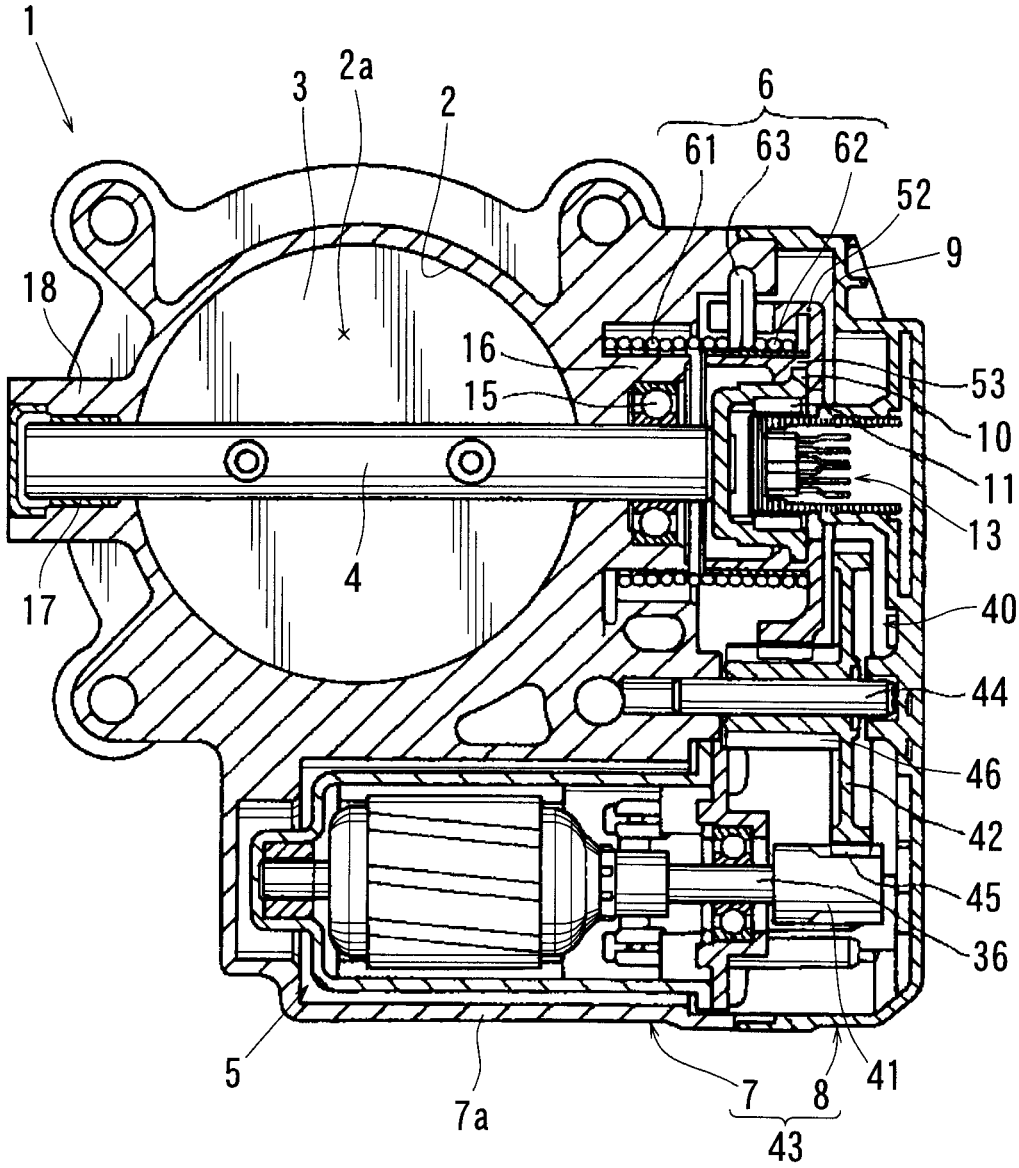
FIG. 1 is a cross-sectional view of an electronically-controlled throttle valve control device according to a representative embodiment of the present invention.

An electronically-controlled throttle valve control device of the present invention is directed to a throttle valve control device that is capable of controlling an amount of intake air introduced into an internal combustion engine (which will be hereinafter simply referred to as an "engine") of a vehicle, e.g., an automobile. As shown in FIG. 1, the electronically-controlled throttle valve control device includes a throttle body 1, a throttle valve 3, a gear reducer 40 (a power transmission device) and a coil spring 6. The throttle body 1 has a cylindrical bore wall 2 that defines an air intake passage 2*a*. The throttle valve 3 is constructed of a disk-shaped butterfly valve. The throttle valve 3 is connected to a throttle shaft 4 and is received in the air intake passage 2*a* of the throttle body 1 so as to close and open the air intake passage 2*a*. The throttle shaft 4 is rotatably attached to the throttle body 1 while crossing the air intake passage 2*a*.

Figure 2:
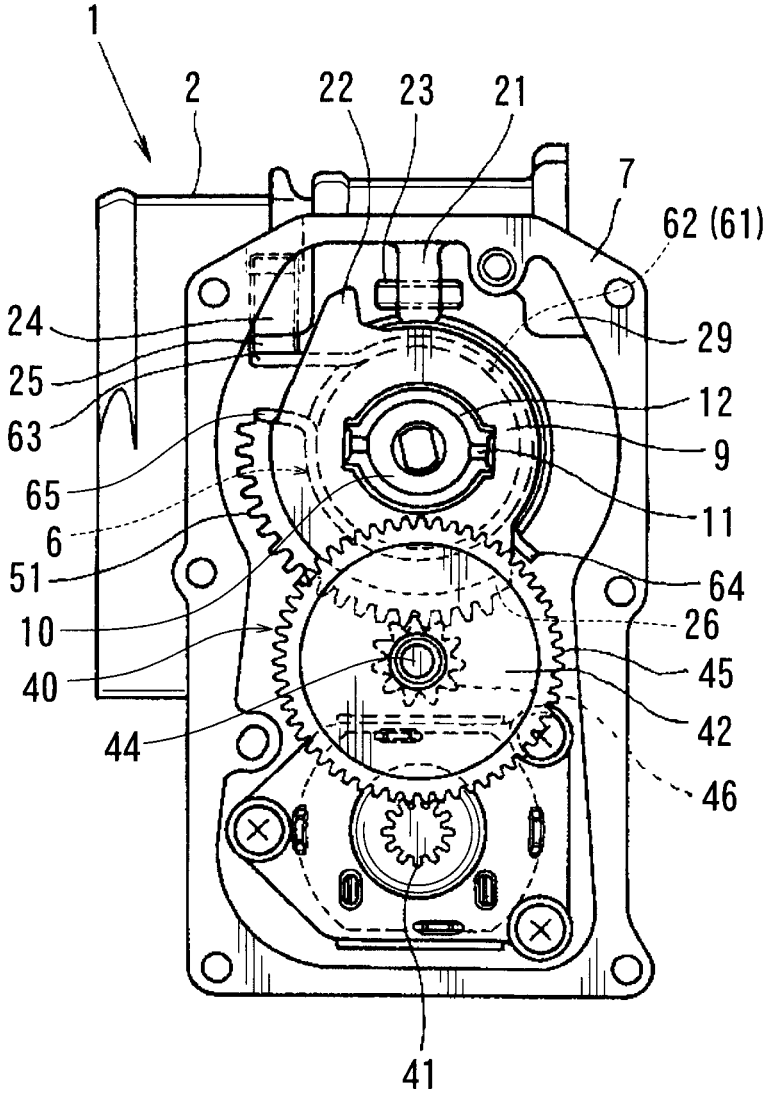
FIG. 2 is a side view of the electronically-controlled throttle valve control device, in which a gear cover is detached.

The gear reducer 40 is arranged and constructed to transfer a rotative force of a drive motor 5 (an actuator) to the throttle valve 3. In particular, as best shown in FIG. 2, the gear reducer 40 is constructed of a valve gear 9 (a rotating body), a pinion gear 41 and an intermediate reduction gear 42. The valve gear 9 is connected to the throttle shaft 4, so as to rotate the throttle valve 3 in a fully opening direction and a fully closing direction. The pinion gear 41 is connected to an output shaft 36 of the drive motor 5. The intermediate reduction gear 42 is meshed with the valve gear 9 and the pinion gear 41.

The drive motor 5 (FIG. 1) is electrically connected to an electronic control unit (ECU) (not shown), so as to be controllably driven in response to a depressing amount of an accelerator pedal (not shown). Further, the throttle body 1 is secured to an intake manifold (not shown) of the engine via fasteners, e.g., fixture bolts and fastening screws.

As shown in FIG. 1, the throttle body 1 includes a cylindrical bearing retainer portion 16 that is positioned in one side (a right side in FIG. 1) thereof. The bearing retainer portion 16 is arranged and constructed to rotatably support one end of the throttle shaft 4 via a ball bearing 15. Also, the throttle body 1 includes a cylindrical bearing retainer portion 18 that is positioned in the other side (a left side in FIG. 1) thereof. The bearing retainer portion 18 is arranged and constructed to rotatably support the other end of the throttle shaft 4 via a dry bearing 17. Further, the throttle body 1 includes an actuator housing 43 that is positioned in one side (the right side in FIG. 1) thereof. The actuator housing 43 is arranged and constructed to receive the drive motor 5 and the gear reducer 40 therein. The actuator housing 43 is composed of an open-sided gear case 7 and a gear cover 8. The gear case 7 is integrally formed in the throttle body 1 and has a side opening. The gear cover 8 is constructed to close the side opening of the gear case 7. Further, the gear case 7 has a motor receiving portion 7*a* in which the drive motor 5 is disposed.

The drive motor 5 is capable of functioning as a drive source and is constructed such that the output shaft 36 thereof can rotate in a normal direction and a reverse direction.

The gear reducer 40 is constructed as a gear drive mechanism that is capable of reducing a rotational speed of the drive motor 5 at a certain reduction ratio. Further, as shown in FIGS. 1 and 2, the intermediate reduction gear 42 of the gear reducer 40 is rotatably supported via a support shaft 44 that is disposed between the gear case 7 and the gear cover 8. The intermediate reduction gear 42 includes a large-diameter gear portion 45 meshing with the pinion gear 41 and a small-diameter gear portion 46 meshing with the valve gear 9. Further, the valve gear 9 is constructed of a sector gear having a gear portion 51 that is formed in an outer circumferential surface thereof. The gear portion 51 is capable of meshing with the small-diameter gear portion 46 of the intermediate reduction gear 42 (FIG. 2).

As shown in FIG. 1, the valve gear 9 has a cylindrical rotor 10 that is integrally formed by insert molding. The rotor 10 may preferably be concentrically positioned with respect to the valve gear 9. The rotor 10 has a pair of (divided) permanent magnets 11 and a pair of (divided) yokes 12 that are respectively positioned in an inner circumferential surface thereof. The rotor 10 is connected to one end (a right end in FIG. 1) of the throttle shaft 4. Further, a hall element 13 (a noncontact detection element) is provided to an inner side surface of the gear cover 8. The hall element 13 is loosely fitted into a cylindrical space of the rotor 10. The hall element 13 can generate an electric signal representative of a magnetic field which changes with rotation of the valve gear 9, so as to output the generated electric signal to the ECU. Further, the permanent magnets 11, the yokes 12 and the hall element 13 may constitute a throttle valve position sensor that is capable of detecting degree of open of the throttle valve 3.

As shown in FIG. 2, the valve gear 9 has a fully closed position stopper 22 and a fully opened position stopper 26 that are formed in an outer circumferential portion thereof. The fully closed position stopper 22 is arranged and constructed to contact a fully closed position detent member 23 when the valve gear 9 rotates to a fully closed position (i.e., when the valve gear 9 rotates to a position corresponding to a fully closed position of the throttle valve 3). The fully closed position detent member 23 is constructed of an adjust screw. The adjust screw is attached to a fully closed position detent member retainer 21 that is formed in an interior side of the gear case 7. Conversely, the fully opened position stopper 26 is arranged and constructed to contact a fully opened position detent member 29 when the valve gear 9 rotates to a fully opened position (i.e., when the valve gear 9 rotates to a position corresponding to a fully opened position of the throttle valve 3). The fully opened position detent member 29 is formed in the interior side of the gear case 7.

Figure 3:
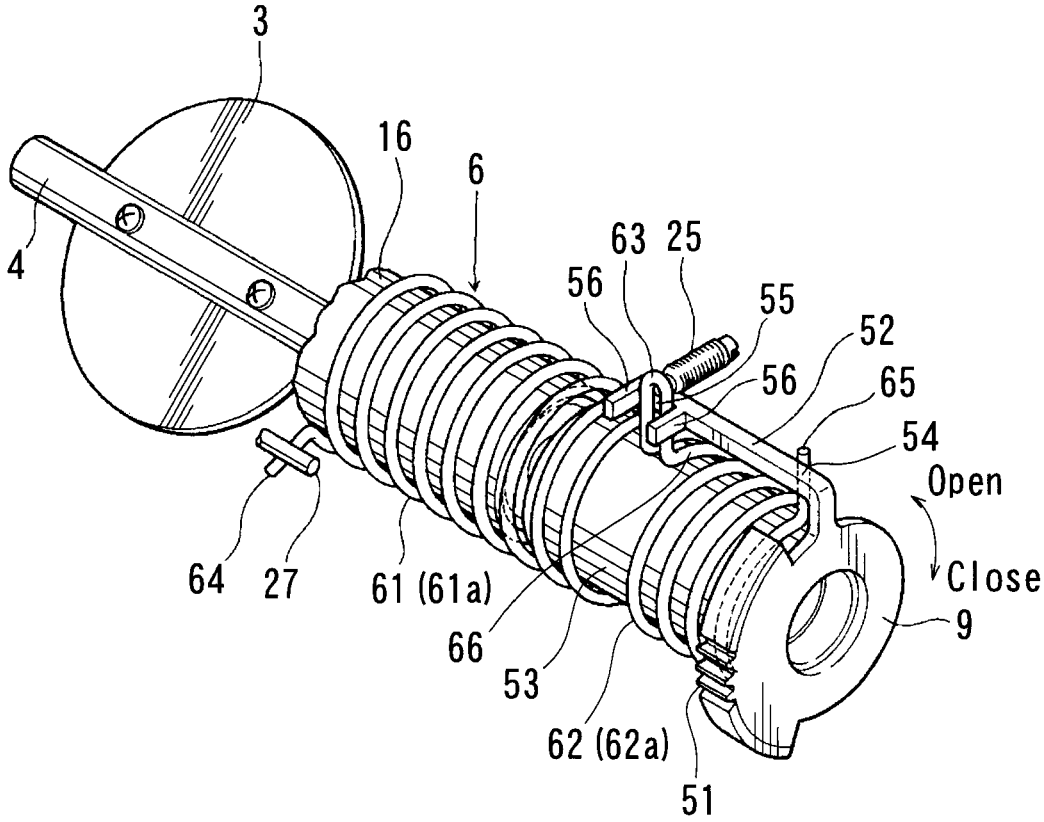
FIG. 3 is a perspective view of a coil spring and related parts of the electronically-controlled throttle valve control device.

As shown in FIGS. 1 and 3, the valve gear 9 has a concentrically formed cylindrical spring guide 53 that is projected toward a bottom wall of the gear case 7. The cylindrical spring guide 53 is positioned opposite to the bearing retainer portion 16 formed in the throttle body 1 and is concentrically positioned with respect to the bearing retainer portion 16. Further, the cylindrical spring guide 53 has the substantially same outer diameter as the bearing retainer portion 16. As best shown in FIG. 3, the valve gear 9 has an opener member 52. The opener member 52 is formed in the outer circumferential portion of the valve gear 9, so as to be projected toward the bottom wall of the gear case 7. The opener member 52 has a second engagement portion 54 that is formed in a proximal end thereof, and an engagement portion 55 that is formed in a distal end thereof. Further, the opener member 52 has a pair of lateral guide members 56 that are formed in the distal end thereof. The lateral guide members 56 may preferably be positioned in parallel with each other.

The coil spring 6 has a first spring portion 61 having a coiled portion 61*a* (which may be referred to as a first coiled portion 61*a*), a second spring portion 62 having a coiled portion 62*a* (which may be referred to as a second coiled portion 62*a*), and a U-shaped hook portion 63. The coil spring 6 is constructed of a one piece torsion coil spring that is formed by shaping a single wire having a substantially constant wire diameter. That is, the first spring portion 61, the second spring portion 62 and the U-shaped hook portion 63 are integrally formed. The first spring portion 61 and the second spring portion 62 are concentrically formed with each other and respectively have different winding directions. The first spring portion 61 has the substantially same coil pitch distance and coil diameter as the second spring portion 62. However, the second spring portion 62 has a winding number smaller than the first spring portion 61. Therefore, the second spring portion 62 has a biasing force smaller than a biasing force of the first spring portion 61. The U-shaped hook portion 63 is formed by bending a portion of the coil spring 6 (a boundary portion of the first and second spring portions 61 and 62) to a substantially U-shape. As a result, the coil spring 6 has a coiled portion (an intermediate coiled portion) 66 that is positioned adjacent to or continuous with the U-shaped hook portion 63 and is positioned between the first and second coiled portions 61*a* and 62*a* of the first and second spring portions 61 and 62. Further, the U-shaped hook portion 63 may function as a winding direction changeover portion in which winding directions of the first and second spring portions 61 and 62 are changed over. That is, the first spring portion 61 has a winding direction different from the second spring portion 62.

As shown in FIG. 1, the coil spring 6 is disposed between the bore wall 2 of the throttle body 1 (the bottom wall of the gear case 7) and the valve gear 9. As shown in FIGS. 1 and 3, a throttle body-side coiled portion of the coil spring 6 (i.e., a bore wall-side portion of the first coiled portion 61*a*) is fitted over the bearing retainer portion 16 and is supported from inside by the bearing retainer portion 16. Thus, the bearing retainer portion 16 may function as a throttle body-side spring guide of the coil spring 6. Further, the coil spring 6 includes a first hook portion 64 that is formed in one end portion thereof (a free end portion of the first spring portion 61). The first hook portion 64 engages a first engagement portion 27 that is formed in the bottom wall of the gear case 7.

As shown in FIGS. 1 and 3, a valve gear-side coiled portion of the coil spring 6 (i.e., a valve gear-side portion of the first coiled portion 61*a* and the entire portion of the second coiled portion 62*a*) is fitted over the spring guide 53 and is supported from inside by the spring guide 53. Thus, the spring guide 53 may function as a valve gear-side spring guide of the coil spring 6. Further, the coil spring 6 includes a second hook portion 65 that is formed in the other end portion thereof (a free end portion of the second spring portion 62). The second hook portion 65 engages a second engagement portion 54 that is formed in the opener member 52 of the valve gear 9.

The U-shaped hook portion 63 of the coil spring 6 disengageably engages the engagement portion 55 of the opener member 52 of the valve gear 9 while it is disposed between the lateral guide members 56 of the opener member 52. Thus, the valve gear 9 is applied with a biasing force via the second spring portion 62 in a direction in which the throttle valve 3 can be opened. Further, a distal end portion (an outer end portion) of the U-shaped hook portion 63 is capable of engaging an intermediate stopper 25. The intermediate stopper 25 is constructed of an adjust screw that is attached to an intermediate stopper retainer 24 (FIG. 2) formed in the interior side of the gear case 7.

Operation of the electronically-controlled throttle valve control device will be described in detail.

When the engine is not actuated, the U-shaped hook portion 63 contacts the intermediate stopper 25 via the biasing force of the first spring portion 61 of the coil spring 6. Also, the U-shaped hook portion 63 contacts the engagement portion 55 of the valve gear 9 via the biasing force of the second spring portion 62 of the coil spring 6. Thus, the valve gear 9 (the throttle valve 3) can be maintained in a middle position (which may be referred to as a default position) between the fully closed position and the fully opened position. This is because the biasing force of the first spring portion 61 is different from the biasing force of the second spring portion 62.

In a normal operation condition, in order to open the throttle valve 3 from the middle position toward the fully opened position, a rotative force of the drive motor 5 in the normal direction is transmitted to valve gear 9 via the pinion gear 41 and the intermediate reduction gear 42. As a result, the valve gear 9 and the throttle shaft 4 can be rotated to open the throttle valve 3. At this time, the engagement portion 55 of the opener member 52 of the valve gear 9 presses the U-shaped hook portion 63 against the biasing force of the first spring portion 61 of the coil spring 6. Consequently, as the valve gear 9 rotates in a valve opening direction, the first spring portion 61 (the first coiled portion 61*a*) can have a biasing force (a restoring force) that is capable of biasing the valve gear 9 in a direction (a first direction) in which the throttle valve 3 can be closed from a position opened beyond the middle position toward the middle position. Further, when the valve gear 9 rotates from the middle position in the valve opening direction, the opener member 52 is maintained in a condition in which the opener member 52 is held between the U-shaped hook portion 63 and the second hook portion 65. As a result, the biasing force of the second spring portion 62 cannot be generated or increased.

To the contrary, in order to close the throttle valve 3 from the middle position toward the fully closed position, a rotative force of the drive motor 5 in the reverse direction is transmitted to valve gear 9. As a result, the valve gear 9 and the throttle shaft 4 can be rotated to close the throttle valve 3. At this time, the second engagement portion 54 of the opener member 52 of the valve gear 9 presses the second hook portion 65 against the biasing force of the second spring portion 62 of the coil spring 6 while the U-shaped hook portion 63 of the coil spring 6 contacts the intermediate stopper 25 of the throttle body 1. Consequently, as the valve gear 9 rotates in a valve closing direction, the second spring portion 62 (the second coiled portion 62*a*) can have a biasing force (a restoring force) that is capable of biasing the valve gear 9 in a direction (a second direction) in which the throttle valve 3 can be opened from a position closed beyond the middle position toward the middle position. Further, as described above, the U-shaped hook portion 63 is maintained in a condition in which the U-shaped hook portion 63 contacts the intermediate stopper 25 when the valve gear 9 rotates from the middle position in the closing direction. As a result, the biasing force of the first spring portion 61 cannot be generated or increased.

According to the electronically-controlled throttle valve control device, if electric power supplied to the drive motor 5 is stopped or lost from any cause when the throttle valve 3 is opened from the middle position toward the fully opened position, the U-shaped hook portion 63 can contact the intermediate stopper 25 of the throttle body 1 by the biasing force of the first spring portion 61 which biasing force is capable of biasing the valve gear 9 in the direction in which the throttle valve 3 can be closed from the position opened beyond the middle position toward the middle position. At this time, the engagement portion 55 of the opener member 52 contacts the U-shaped hook portion 63 by the biasing force of the second spring portion 62. To the contrary, if electric power supplied to the drive motor 5 is stopped or lost when the throttle valve 3 is closed from the middle position toward the fully closed position, the engagement portion 55 of the opener member 52 can contact the U-shaped hook portion 63 by the biasing force of the second spring portion 62 which biasing force is capable of biasing the valve gear 9 in the direction in which the throttle valve 3 can be opened from the position closed beyond the middle position toward the middle position. At this time, the U-shaped hook portion 63 contacts the intermediate stopper 25 of the throttle body 1 by the biasing force of the first spring portion 61. Thus, even if electric power supplied to the drive motor 5 is stopped, the throttle valve 3 can be maintained in the middle position, so that the engine can be prevented from being suddenly stopped. As a result, the vehicle can be moved to a safe place.

Next, the electronically-controlled throttle valve control device will be further described in detail.

Figure 7:
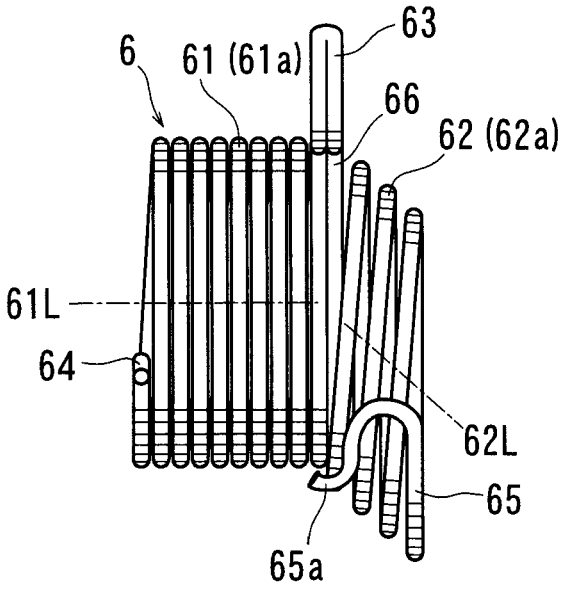
FIG. 7 is a side view of the coil spring.

As shown in FIG. 7, the second hook portion 65 of the coil spring 6 includes an end portion 65*a*. The end portion 65*a* is bent into an S-shape, so as to be positioned on the second coiled portion 62*a* of the second spring portion 62. Further, the second coiled portion 62*a* of the second spring portion 62 may preferably be formed such that a central axis 62L thereof can be offset or angled relative to a central axis 61L of the first coiled portion 61*a* of the first spring portion 61 in a certain direction (downwardly in FIG. 7). Therefore, as shown in FIG. 5, when the coil spring 6 is attached to the valve gear 9 (i.e., when the coil spring 6 is fitted over the spring guide 53), the second coiled portion 62*a* of the second spring portion 62 can be rotationally deformed or displaced in an opposite direction (upwardly in FIG. 7), so that the central axis 62L of the second coiled portion 62*a* can substantially be aligned with the central axis 61L of the first coiled portion 61*a*.

Figure 6:
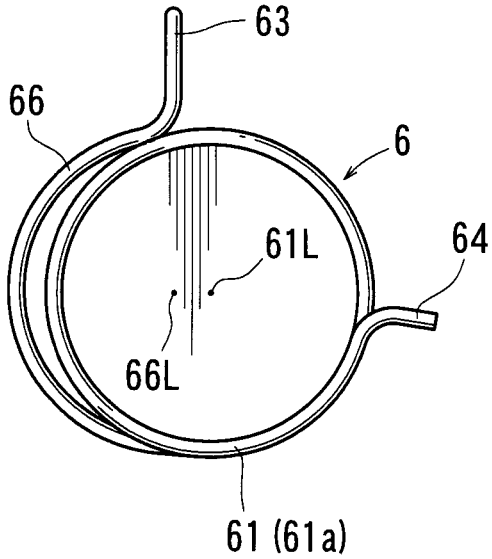
FIG. 6 is an elevational view of the coil spring.

Further, as shown in FIG. 6 (in which the second spring portion 62 of the coil spring 6 is omitted), the intermediate coiled portion 66 of the coil spring 6 may preferably be formed such that a central axis 66L thereof can be displaced radially outwardly (leftwardly in FIG. 6) relative to the central axis 61L of the first coiled portion 61*a* of the first spring portion 61. Thus, the intermediate coiled portion 66 of the coil spring 6 can be positioned radially outwardly relative to the first coiled portion 61*a* of the first spring portion 61 (which coiled portion may be referred to as "a remaining coiled portion" of the coil spring 6). Therefore, when the coil spring 6 is fitted over the spring guide 53 of the valve gear 9, a pressing force (shown by an arrow y in FIG. 8) of the intermediate coiled portion 66 of the coil spring 6 against the spring guide 53 can be effectively reduced. In other words, the intermediate coiled portion 66 can be prevented from being strongly pressed against the spring guide 53.

Figure 4:
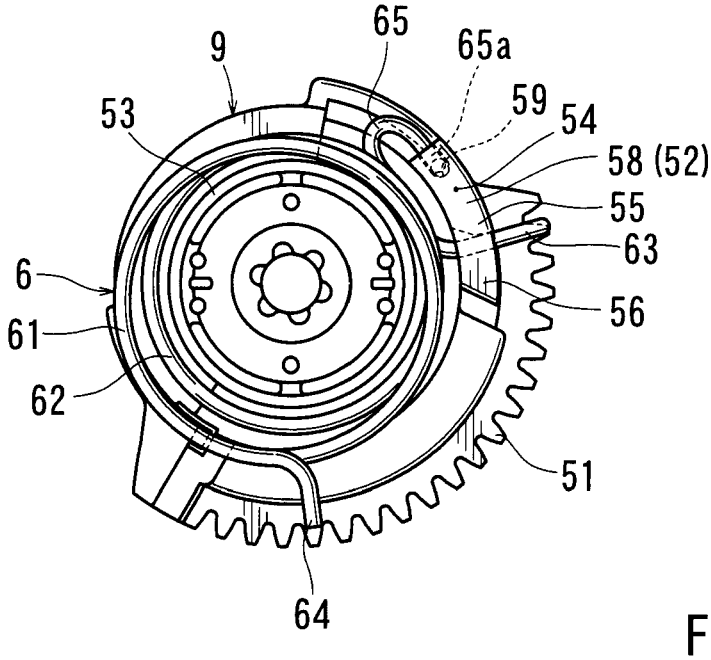
FIG. 4 is an elevational view of a valve gear to which the coil spring is coupled.
Figure 5:
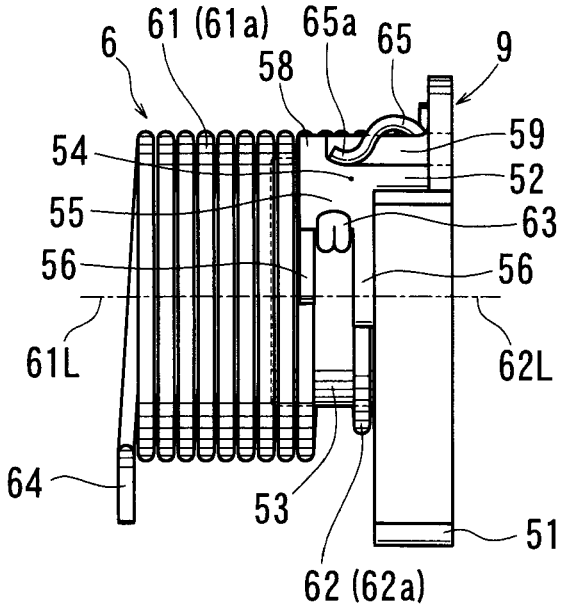
FIG. 5 is a side view of the valve gear to which the coil spring is coupled.

As shown in FIGS. 4 and 5, the valve gear 9 has a curved cover portion 58 that is capable of partially covering the second coiled portion 62*a* of the second spring portion 62. The opener member 52 is integrated with the cover portion 58. Further, the second engagement portion 54 and the engagement portion 55 may preferably be formed in opposite sides of the opener member 52. Further, a recessed portion 59 is formed in the cover portion 58. The recessed portion 59 is positioned adjacent to the second engagement portion 54 of the opener member 52. The recessed portion 59 is shaped such that the second hook portion 65 of the coil spring 6 can engage the same when the coil spring 6 is attached to the valve gear 9.

Figure 8:
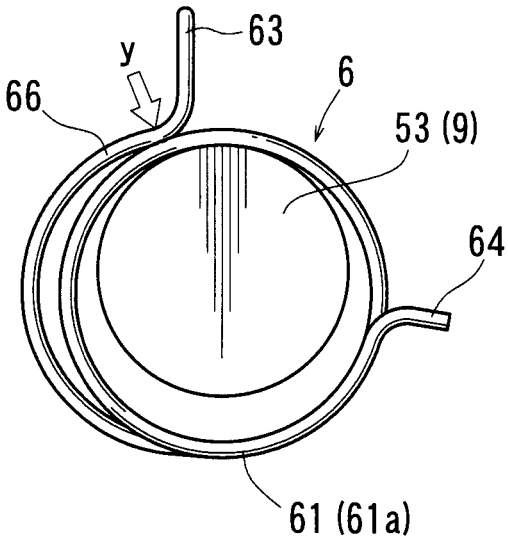
FIG. 8 is an explanatory view, which shows a relation between the coil spring and a spring guide.
Figure 9:
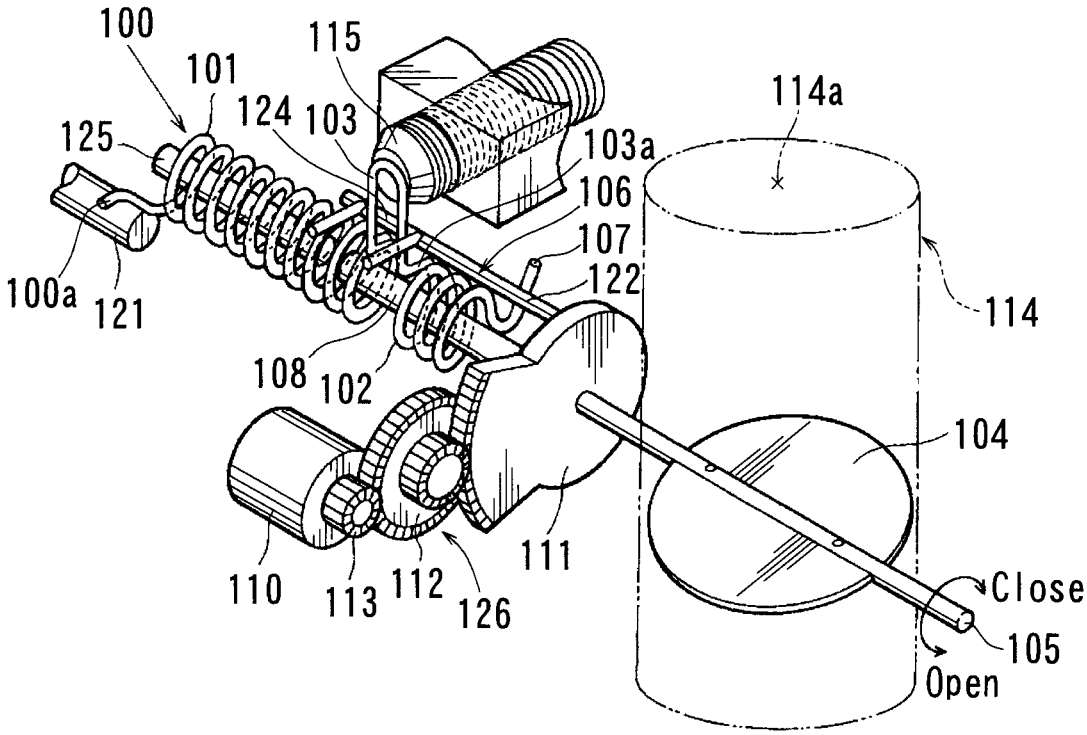
FIG. 9 PRIOR ART
FIG. 9 is a perspective view of essential portions of a conventional electronically-controlled throttle valve control device.
Figure 10:
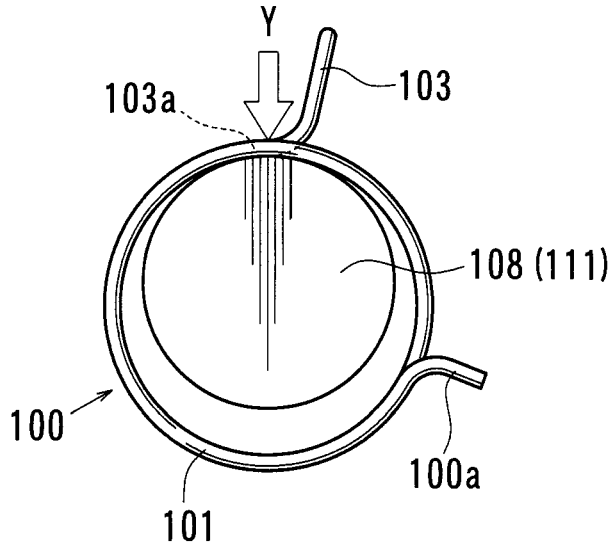
FIG. 10 PRIOR ART
FIG. 10 is an explanatory view, which shows a relation between a coil spring and a spring guide.

Next, procedures for attaching the coil spring 6 to the valve gear 9 will be described. First, the valve gear-side coiled portion of the coil spring 6 is fitted over the spring guide 53 of the valve gear 9. Subsequently, the second hook portion 65 of the coil spring 6 is inserted into the recessed portion 59 of the valve gear 9, and the S-shaped end portion 65*a* of the second hook portion 65 is engaged with the second engagement portion 54 of the opener member 52. Further, the U-shaped hook portion 63 of the coil spring 6 is disengageably engaged with the engagement portion 55 while the U-shaped hook portion 63 is positioned between the lateral guide members 56 of the opener member 52. Thus, the valve gear 9 can be applied with the biasing force via the second spring portion 62 in the direction in which the throttle valve 3 can be opened. At this time, the intermediate coiled portion 66 of the coil spring 6 is positioned radially outwardly relative to the first coiled portion 61*a* of the first spring portion 61. Therefore, when the coil spring 6 is attached to the valve gear 9, the intermediate coiled portion 66 of the coil spring 6 can be spaced from the spring guide 53 (FIG. 8). Further, in this embodiment, the second coiled portion 62*a* of the second spring portion 62 is formed such that the central axis 62L thereof can be angled relative to the central axis 61L of the first coiled portion 61*a* of the first spring portion 61. Therefore, when the coil spring 6 is attached to the valve gear 9, the central axis 62L of the second coiled portion 62*a* can substantially be aligned with the central axis 61L of the first coiled portion 61*a*. As a result, a cylindrical space (not shown) can be formed between the spring guide 53 and the second coiled portion 62*a* of the second spring portion 62.

After the coil spring 6 is attached to the valve gear 9, the valve gear 9 having the coil spring 6 is connected to the throttle shaft 4 while the throttle body-side coiled portion of the coil spring 6 (the first coiled portion 61*a* of the first spring portion 61) is fitted over the bearing retainer portion 16 of the throttle body 1. Further, the first hook portion 64 of the coil spring 6 is engaged with the first engagement portion 27 of the throttle body 1 (FIG. 3). Further, the rotor 10 of the valve gear 9 is connected to the throttle shaft 4 (FIG. 1).

According to the electronically-controlled throttle valve control device, when the throttle valve 3 is closed and opened between the middle position and the fully closed position, the valve gear 9 is rotated while the U-shaped hook portion 63 of the coil spring 6 engages or contacts the intermediate stopper member 25 of the throttle body 1. As a result, the spring guide 53 of the valve gear 9 can move or rotate relative to the intermediate coiled portion 66 of the coil spring 6.

However, when the coil spring 6 is fitted over the spring guide 53 of the valve gear 9, the pressing force (shown by an arrow y in FIG. 8) of the intermediate coiled portion 66 of the coil spring 6 against the spring guide 53 can be effectively reduced because the intermediate coiled portion 66 can be positioned radially outwardly relative to the first coiled portion 61*a* of the first spring portion 61. Therefore, in a condition in which the coil spring 6 is attached to the valve gear 9, when the intermediate coiled portion 66 is pressed against the spring guide 53 of the valve gear 9 due to a reactive force of the second spring portion 62, the intermediate coiled portion 66 can be prevented from being strongly pressed against the spring guide 53. That is, the intermediate coiled portion 66 can contact the spring guide 53 with a small contact force in comparison with the conventional electronically-controlled throttle valve control device. In some situations, the intermediate coiled portion 66 can be maintained in a condition in which the intermediate coiled portion 66 are spaced from the spring guide 53 without contacting the same. Therefore, when the spring guide 53 moves or rotates relative to the intermediate coiled portion 66, a sliding frictional force generated between the intermediate coiled portion 66 and the spring guide 53 can be reduced. As a result, a rotational load applied to the drive motor 5 can be reduced. Further, a noise generated between the intermediate coiled portion 66 and the spring guide 53 can be prevented.

The intermediate coiled portion 66 of the coil spring 6 is formed such that the central axis 66L thereof can be displaced radially outwardly relative to the central axis 61L of the first coiled portion 61*a* of the first spring portion 61. That is, the intermediate coiled portion 66 of the coil spring 6 is positioned radially outwardly beyond the first coiled portion 61*a* of the first spring portion 61 (FIG. 6). Therefore, when the coil spring 6 is fitted over the spring guide 53 of the valve gear 9, the pressing force (shown by the arrow y in FIG. 8) of the intermediate coiled portion 66 against the spring guide 53 can be effectively reduced. In other words, the intermediate coiled portion 66 can be prevented from being strongly pressed against the spring guide 53.

Thus, in the coil spring 6 of the present embodiment, the central axis 66L of the intermediate coiled portion 66 of the coil spring 6 is simply displaced radially outwardly relative to the central axis 61L of the first coiled portion 61*a* of the first spring portion 61 in order to reduce the pressing force of the intermediate coiled portion 66 against the spring guide 53. Therefore, it is possible to manufacture the coil spring 6 in which the pressing force of the intermediate coiled portion 66 against the spring guide 53 can be effectively reduced.

Further, the central axis 62L of the second coiled portion 62*a* of the second spring portion 62 is angled relative to the central axis 61L of the first coiled portion 61*a* of the first spring portion 61. Therefore, when the coil spring 6 is attached to the valve gear 9, the cylindrical space can be formed between the spring guide 53 and the second coiled portion 62*a* of the second spring portion 62, so that the second coiled portion 62*a* can substantially be prevented from contacting the spring guide 53. As a result, when the spring guide 53 and the second coiled portion 62*a* of the second spring portion 62 move relative to each other due to actuation of the electronically-controlled throttle valve control device, a sliding frictional force generated between the spring guide 53 and the second coiled portion 62*a* of the second spring portion 62 can be reduced.

Various changes and modifications may be made to the electronically-controlled throttle valve control device. For example, in the embodiment, the coil spring 6 is constructed of a one piece torsion coil spring. However, the coil spring 6 can be constructed of two or more spring components that are respectively separately formed.

Further, in the embodiment, the central axis 66L of the intermediate coiled portion 66 of the coil spring 6 is displaced radially outwardly relative to the central axis 61L of the first coiled portion 61*a* of the first spring portion 61. Instead, a coil diameter of the intermediate coiled portion 66 can be increased.

Further, in the embodiment, the central axis 62L of the second coiled portion 62*a* of the second spring portion 62 is angled relative to the central axis 61L of the first coiled portion 61*a* of the first spring portion 61. However, the central axis 62L of the second coiled portion 62*a* of the second spring portion 62 can be aligned with the central axis 61L of the first coiled portion 61*a* of the first spring portion 61, if necessary.

Further, in the embodiment, the opener member 52 and the spring guide 53 are respectively formed in the valve gear 9.

Instead, the opener member 52 and the spring guide 53 can be formed in the throttle shaft 4. In this modification, the throttle shaft 4 may function as the rotating body.

Further, in the embodiment, the hall element 13 is used as the noncontact detection element of the throttle valve position sensor. However, the hall element 13 can be replaced with a hall IC, a magnetoresistive element or other such elements.

Further, the divided permanent magnets 11 of the rotor 10 can be replaced with a cylindrical permanent magnet. Also, shapes of the U-shaped hook portion 63, the first hook portion 64 and the second hook portion 65 can be changed, if necessary.

What is claimed is:

1. An electronically-controlled throttle valve control device, comprising: a throttle body having an air intake passage formed therein; a throttle valve that is received in the air intake passage so as to close and open the air intake passage; a power transmission device having a rotating body that is capable of transferring a rotative force of an actuator to the throttle valve and rotating the throttle valve in a fully opening direction and a fully closing direction; and a coil spring having one end portion that is engaged with the throttle body and the other end portion that is engaged with the rotating body, the coil spring being arranged and constructed to bias the throttle valve in the fully opening direction or the fully closing direction; wherein the rotating body has a spring guide that is capable of supporting the coil spring from inside and has an opener member that is biased by the coil spring in the fully opening direction or the fully closing direction, wherein the coil spring includes a first spring portion that is capable of biasing the throttle valve via the opener member in a direction in which the throttle valve can be closed from a position opened beyond the middle position toward the middle position, a second spring portion that is capable of biasing the throttle valve via the opener member in a direction in which the throttle valve can be opened from a position closed beyond the middle position toward the middle position, and a winding direction changeover portion in which winding directions of the first and second spring portions are changed over, wherein the coil spring is mounted such that a coiled portion positioned adjacent to the winding direction changeover portion is positioned radially outwardly relative to a remaining coiled portion; and wherein the first spring portion has the same coil diameter as the second spring portion.

2. The electronically-controlled throttle valve control device as defined in claim 1, wherein the coil spring is formed such that a central axis of the coiled portion positioned adjacent to the winding direction changeover portion is displaced radially outwardly relative to a central axis of the remaining coiled portion.

3. An electronically-controlled throttle valve control device, comprising: a throttle body having an air intake passage formed therein; a throttle valve that is received in the air intake passage so as to close and open the air intake passage; a rotating body that is capable of rotating the throttle valve in a fully opening direction and a fully closing direction; a coil spring that is engaged with the throttle body and the rotating body to bias the throttle valve in the fully opening direction or the fully closing direction; a spring guide that is provided to the rotating body and is capable of supporting the coil spring from inside; and an opener member that is provided to the rotating body and is biased by the coil spring in the fully opening direction or the fully closing direction, wherein the coil spring includes a first coiled portion that is capable of biasing the throttle valve in a first direction, a second coiled portion that is capable of biasing the throttle valve in a second direction, and an intermediate coiled portion that is positioned between the first and second coiled portions, wherein the coil spring is mounted such that a central axis of the intermediate coiled portion is displaced radially outwardly relative to a central axis of the first coiled portion, and wherein the first coiled portion has the same coil diameter as the second coiled portion.

* * * * *

UNITED STATES PATENT AND TRADEMARK OFFICE

CERTIFICATE OF CORRECTION

PATENT NO. : 8,448,627 B2
APPLICATION NO. : 12/875334
DATED : May 28, 2013
INVENTOR(S) : Masanobu Kondo, Toru Sakurai and Atsushi Tanaka It is certified that error appears in the above-identified patent and that said Letters Patent is hereby corrected as shown below:

Title Page:

Item 73 should read

(73) Assignee: AISAN KOGYO KABUSHIKI KAISHA, Aichi-ken (JP)
DENSO CORPORATION, Aichi-ken, (JP)

Signed and Sealed this
Twenty-third Day of February, 2016

Michelle K. Lee

Michelle K. Lee
*Director of the United States Patent and Trademark Office*